US008863946B2

(12) United States Patent
Gillespie

(10) Patent No.: US 8,863,946 B2
(45) Date of Patent: Oct. 21, 2014

(54) CONTAINER APPARATUS

(76) Inventor: Thomas E. Gillespie, Cleveland, OH (US)

( * ) Notice: Subject to any disclaimer, the term of this patent is extended or adjusted under 35 U.S.C. 154(b) by 116 days.

(21) Appl. No.: 13/442,274

(22) Filed: Apr. 9, 2012

(65) Prior Publication Data

US 2012/0255879 A1 Oct. 11, 2012

Related U.S. Application Data

(60) Provisional application No. 61/472,784, filed on Apr. 7, 2011.

(51) Int. Cl.

| | |
|---|---|
| ***B65D 51/28*** | (2006.01) |
| ***A63B 71/00*** | (2006.01) |
| *A63C 11/02* | (2006.01) |
| *A63B 55/00* | (2006.01) |

(52) U.S. Cl.

CPC ..... *A63B 71/0036* (2013.01); *A63C 11/025* (2013.01); *A63B 55/00* (2013.01)

USPC ..... 206/38

(58) Field of Classification Search

CPC .... B65D 85/20; B65D 51/18; A63B 71/0036; A63B 55/00; A63C 11/025

USPC ..... 206/216, 38.1, 38

See application file for complete search history.

(56) References Cited

U.S. PATENT DOCUMENTS

| | | | | | |
|---|---|---|---|---|---|
| 1,414,875 | A | | 5/1922 | Hanaford | |
| 2,707,552 | A | * | 5/1955 | Matthiesen | 206/537 |
| 3,567,085 | A | * | 3/1971 | Flores | 224/604 |
| 4,393,974 | A | * | 7/1983 | Levesque | 206/37 |
| 4,643,302 | A | | 2/1987 | Baumgardner | |
| 4,765,459 | A | * | 8/1988 | Edwards | 206/38.1 |
| 5,318,177 | A | * | 6/1994 | Isacson | 206/38.1 |
| D361,507 | S | * | 8/1995 | Langemann | D3/201 |
| 5,823,336 | A | | 10/1998 | Smith | |
| 6,186,352 | B1 | * | 2/2001 | Hwang | 220/23.86 |
| 6,371,291 | B1 | | 4/2002 | Laffy | |
| 7,694,808 | B1 | | 4/2010 | Lin et al. | |
| 8,517,171 | B1 | * | 8/2013 | Delgado | 206/38.1 |

* cited by examiner

*Primary Examiner* — Anthony Stashick
*Assistant Examiner* — King M Chu
(74) *Attorney, Agent, or Firm* — Fay Sharpe LLP

(57) ABSTRACT

Disclosed is a sports container apparatus including a rigid tube or shell with opposing open ends. First and second opposing ends having a first end cap and a second end cap, respectively. The first and second end caps are radially fluted and operably attached to the rigid tube in a sealed manner. The sports container is operative for use as a golf bag or transport container and configured to balance stored articles such as golf clubs. The sports container configured to carry golf clubs or other items while being protected from an exposed environment where collisions with other hard surfaced items or the elements could cause damage. The device easily and safely mounts golf clubs or other items to a motorcycle, bicycle, ATV, or other vehicle without the use of brackets or other mounting devices while maintaining a balanced equilibrium.

17 Claims, 9 Drawing Sheets

TRAVEL TUBE

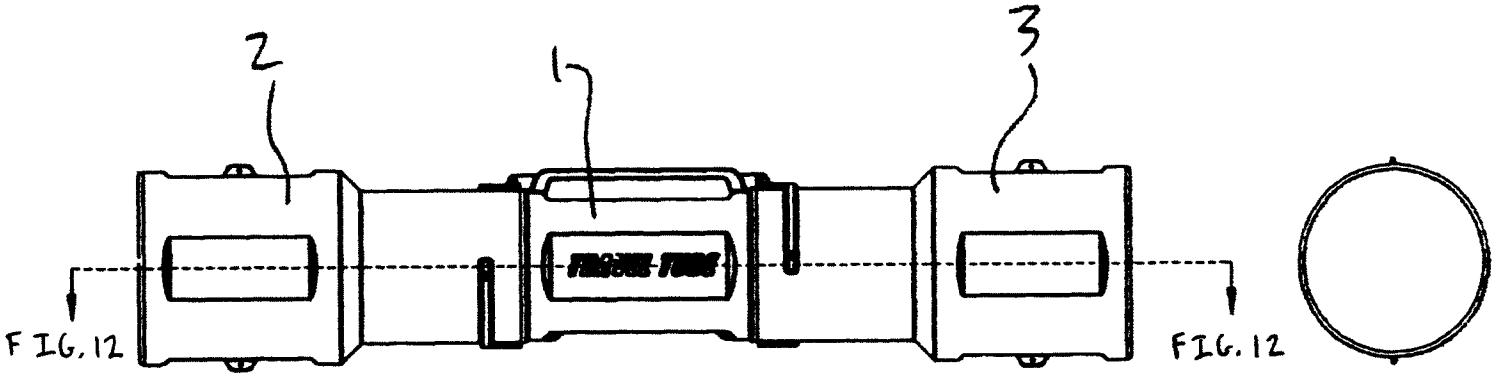
FIG. 14
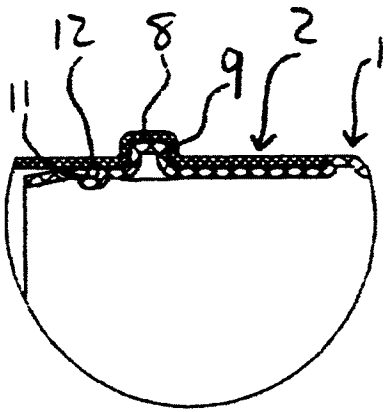
FIG. 13
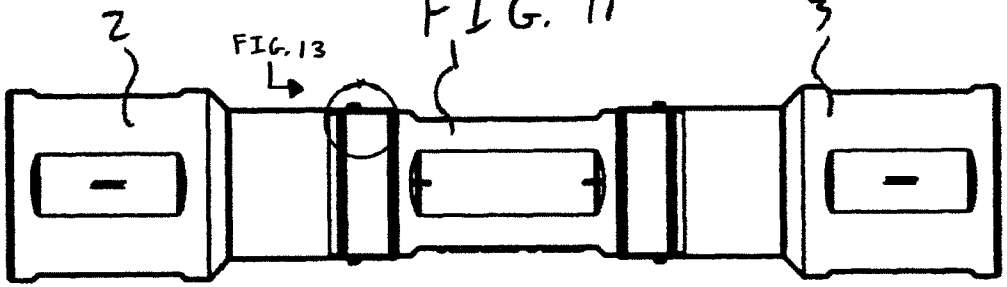
FIG. 11
FIG. 12

CONTAINER APPARATUS

This application claims the benefit of U.S. Provisional Patent Application No. 61/472,784, filed on Apr. 7, 2011.

BACKGROUND

The present exemplary embodiment relates to a rigid container or packaging apparatus. It finds particular application in conjunction with luggage containers for sporting equipment, and will be described with particular reference thereto. However, it is to be appreciated that the present exemplary embodiment is also amenable to other like applications.

Current sport containers or other hard case carrying devices are subject to multiple design limitations. For example, some containers are susceptible to water intrusion. Other containers are generally loaded from one main end whereby balance or equilibrium of the loaded container is subject to moment loads when transported by a user. Current sports containers, particularly golf bags are subject to unbalanced weight distribution due to the nature of articles stored therein. Many golf bags are susceptible to damage if used to transport or ship golf equipment while also being used during play on a golf course. Conversely, current hard-shelled golf travel cases that protect golf clubs during shipping are generally not conducive for use in play.

More particularly, hard-shelled golf cases are either configured to provide protection of equipment to be transported or for use in play. These cases do not possess the versatility to provide rigid protection to a wide variety of unbalanced articles, such as golf clubs, during transport and also be configured for use in play while maintaining balanced in an equilibrium state. These golf bags increase risk of injury to a user while carrying the bag and its contents on his person while also riding a motorcycle, bicycle or an all terrain vehicle. Additionally, some cases do not allow for access to the interior contents from both ends of the container or do not allow for full disassembly of the device that allows for quick and thorough cleaning.

Therefore, for the foregoing reasons, there remains a need for a device that is less cumbersome than known sports cases, that is operative for use on the golf course during play, and is also configured to provide rigid protection during transport and storage. There is also a need for a sports case that allows for a compact, durable, evenly weighted, and weather resistance sports travel case providing access to both ends of the container with caps having an increased internal radial area for storage therein.

BRIEF DESCRIPTION

In accordance with one aspect of the present exemplary embodiment, disclosed is a container device comprising a tube body made of a unitary thin wall material with a first open end and an oppositely disposed second open end. A first end cap made of a unitary thin wall material defining a cavity with a first closed base end and an oppositely disposed first attachment end, the first attachment end having a first rim with a greater cross sectional area than the first open end of the tube body and being configured to operably attach to the first open end of the tube body. A second end cap made of a unitary thin wall material defining a cavity with a second base end and an oppositely disposed second attachment end, the second attachment end having a second rim with a greater cross sectional area than the second open end of the tube body and is configured to operably attach to the second end of the tube body such that the cavity formed by the first end cap is in communication with the cavity formed by the second end cap through the tube body.

In accordance with another aspect, disclosed is a sports container apparatus including a water resistant enclosure having a rigid tube or shell with opposing open ends. Each end having an end cap. The first and second end caps are radial fluted and operably attached to the rigid tube in a manner that seals the tube or shell. The sports container is operative for use as a golf bag or transport container for elongated equipment and configured to balance stored articles such as golf clubs, skis, rifles, baseball bats, fishing poles, blueprints or artwork.

In accordance with another aspect of the present embodiment, disclosed is a sports container comprising a generally water resistant enclosure having a rigid tube with opposing open ends. A first open end and a second open end of the tube are configured to be operably attached to a first end cap and a second end cap in a sealed manner, respectively. The first and second end caps having a generally similar profile that includes a neck portion extending from a rim of the cap to a radially fluted portion, the radially fluted portion extends from the neck portion to an end portion that is attached to a closed base end such that the end portion includes a cross sectional area that is greater than a cross sectional area of the rigid tube.

In accordance with another embodiment, provided is a sports container including an elongated tube, a first end cap and a second end cap. The sports container including an elongated tube, a first cap at a first end of the tube and a second cap at a second end of the tube. The tube and caps having a substantially similar composition. The caps can be approximately 60%-80% of the size of the assembled container. In one embodiment, the caps are approximately 76% of the size of the assembled container.

Still other features and benefits of the present disclosure sill become apparent from the following detailed description.

BRIEF DESCRIPTION OF THE DRAWINGS

FIG. 11 is a side view of the container;

FIG. 12 is a cross sectional view of the side view of the container illustrated in FIG. 11;

FIG. 13 is an exploded view of a threaded connection of the cross sectional view of the side view of the container illustrated in FIG. 12;

FIG. 14 is an end view of the container;

DETAILED DESCRIPTION

Figure 1:
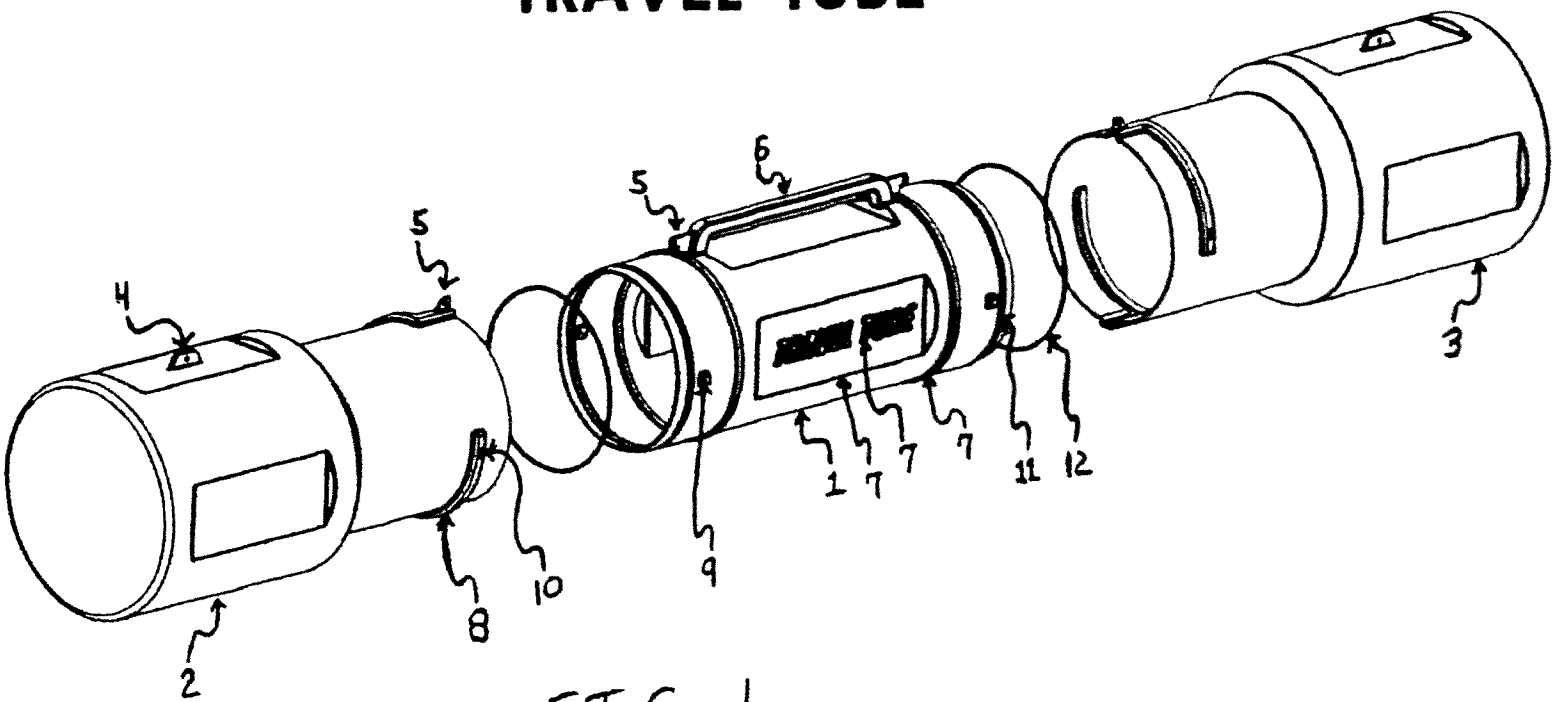
FIG. 1 is a perspective view of a container device.
Figure 2:
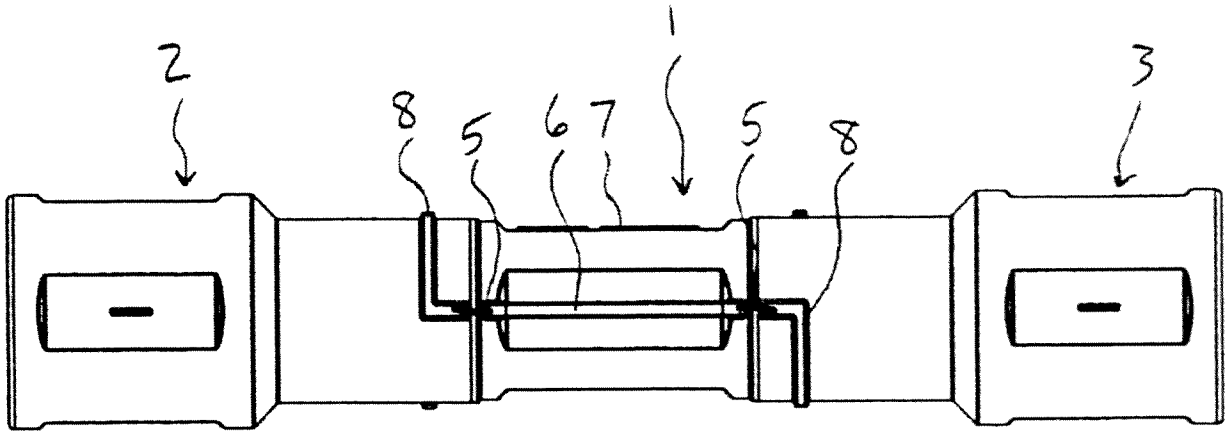
FIG. 2 is top view of the container device.
Figure 3:
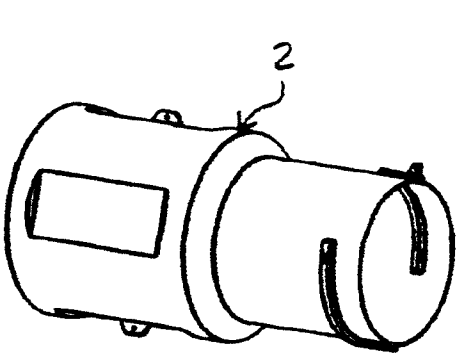
FIG. 3 is a perspective view of a cap of the container device.
Figure 6:
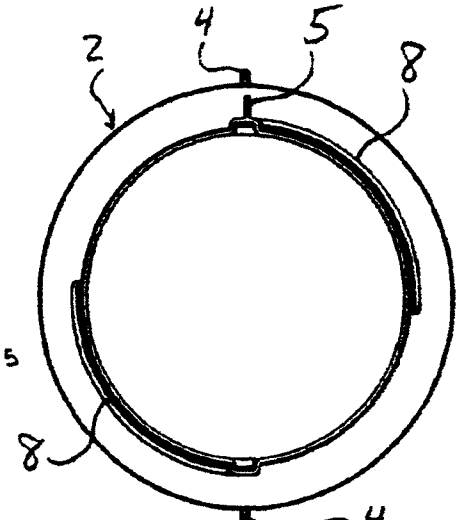
FIG. 6 is an end view of the cap of the container device.
Figure 5:
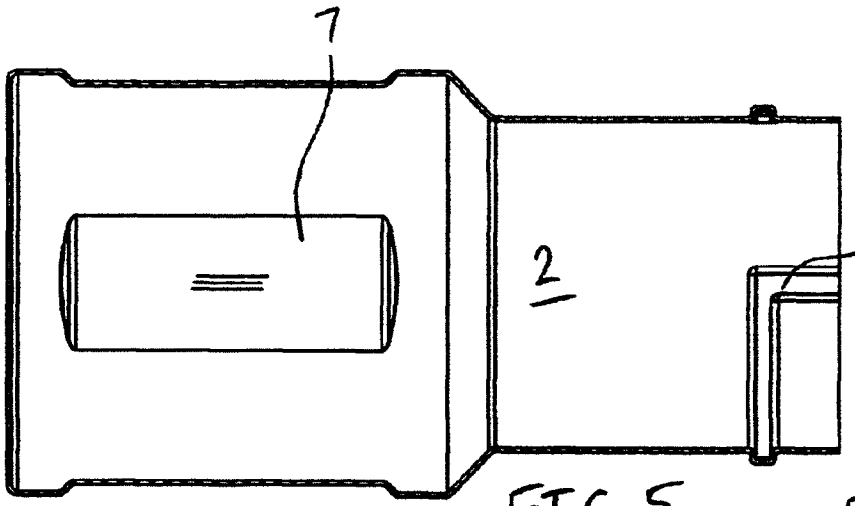
FIG. 5 is a cross sectional view of the side view of the container device as illustrated in FIG. 4.
Figure 4:
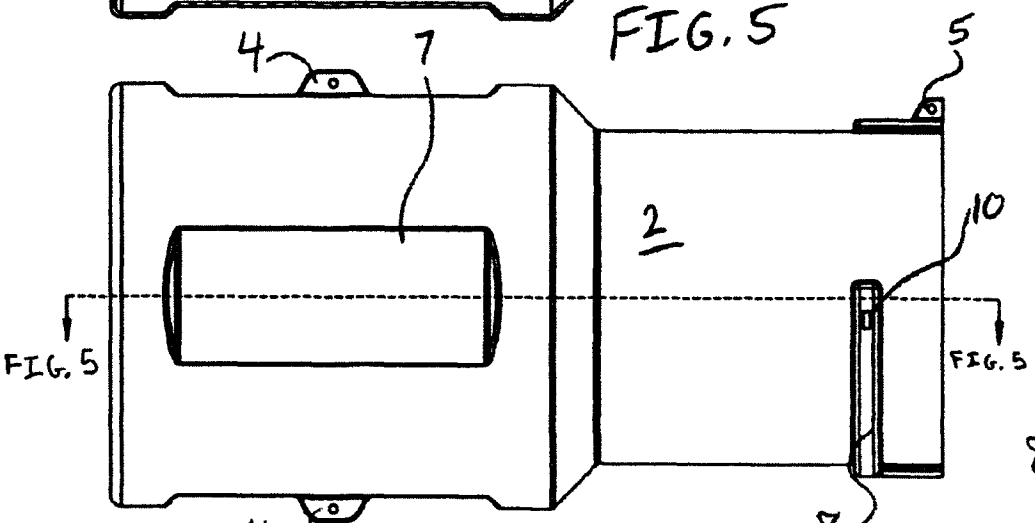
FIG. 4 is a side view of the cap of the container device.
Figures 7, 8, 9, 10:
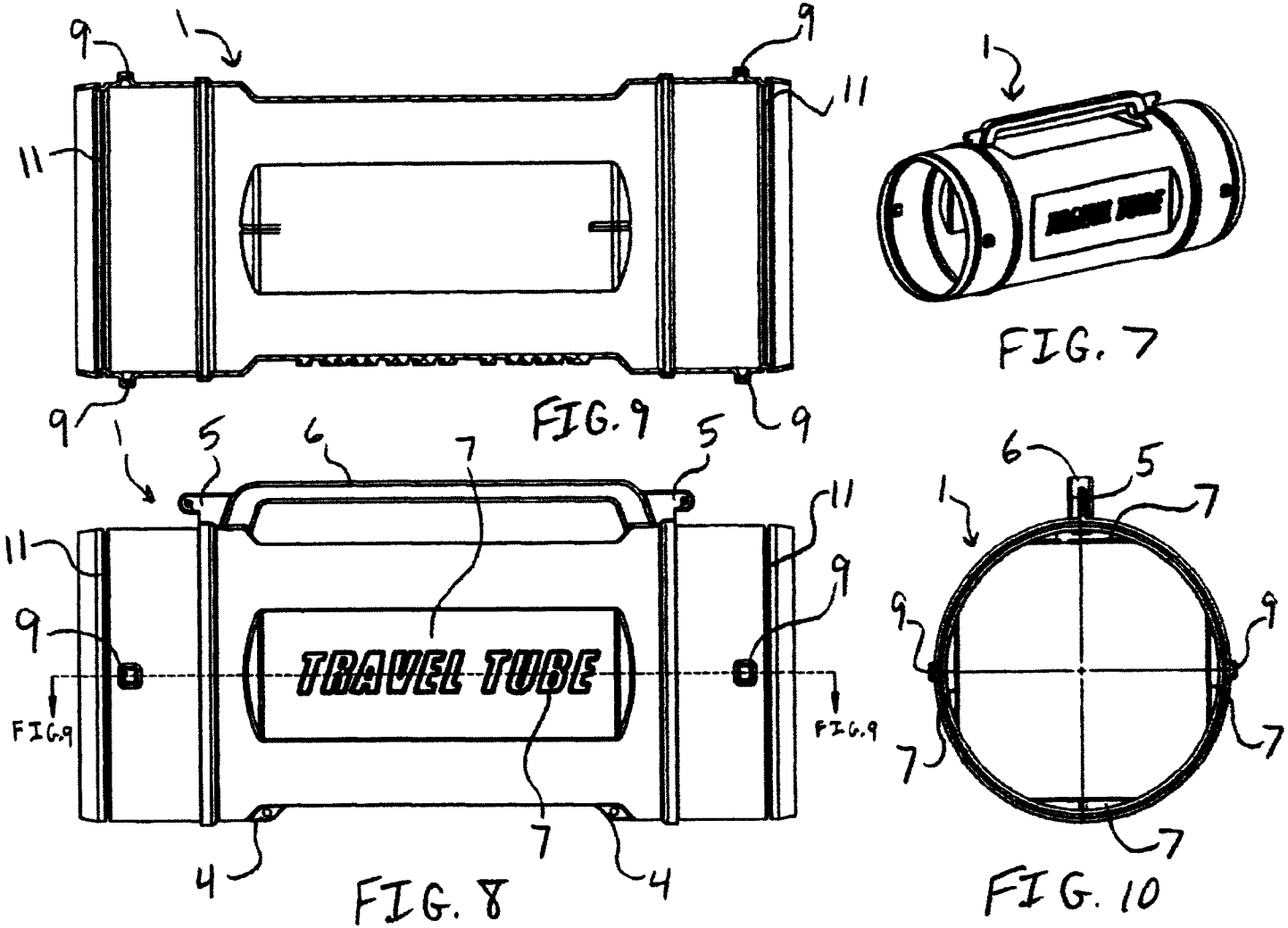
FIG. 7 is a perspective view of a tube body of the container device.
FIG. 8 is a side view of the tube body of the container device.
FIG. 9 is a cross sectional view of the side view of the tube body as illustrated in FIG. 8.
FIG. 10 is an end view of the tube body of the container device.

With reference to FIGS. 1-14, a tube body 1 is a center section operable attached to a first end cap 2 and a second end cap 3. The end caps are cylindrically shaped and include a fluted radial diameter and a larger cross sectional area than the tube body 1. Attachment protrusions 4 are integrally molded with caps 2, 3 and tube body 1. Locking stops 5 are aligned on the tube body 1 and end caps 2, 3 to abut another from as the caps 2, 3 are lockingly positioned about the tube body 1 such that the further rotational movement of cap is prevented and an associated locking device is accommodated. A handle 6 is integrally molded to the tube body 1.

A plurality of structural depressions and elevations 7 are integrated to the tube body 1 and end caps 2, 3 to provide structural rigidity. Depressions and elevations 7 can alternatively be formed into any number of configurations including indicia as well as operational function features (Handle, Threads etc.) and visual features (Longitudinal depressions, Raised lettering etc.) A cap attachment mechanism is configured as a quarter turn thread 8 with at least one detent and thread key block 9. The detent and thread key block are operative to coincide with a quarter turn thread 8 on the caps 2, 3.

In one embodiment, the cap thread 8 includes a first lateral ridge extending from a rim of the cap and generally perpendicular to a longitudinal axis of the tube body and a second radial ridge that abuts the first lateral ridge and extends a portion about the radial perimeter of each cap. The key block 9 and detent is aligned with the cap threads 8. Thread recess 10 is a slightly raised section on the interior of the quarter turn cap thread 8 which passes over the thread key block detent such that the cap 9 is held in place and prevented from rotating loose. A seal channel 11 is a recessed channel at the tube body 1 to accommodate an O-ring seal 12.

The tube body 1 can include an inside diameter from less than 5 inches (0.127 m) to over 10 inches (0.254 m) (preferred approximately 7 inches (0.178 m)). The container device can be made of any light-weight material, which can be molded or machined (preferred plastic blow, rotational, or injection molded or aluminum machined). The threads may be male or female threaded at the end cap or tube body. Additionally, the cap attachment mechanism may be of any connection type known in the art to attach similar materials (preferred quarter turn male threaded as shown). In one embodiment, four or more attachment protrusions are molded or machined holes located on various points of the container. The handle is molded or machined or can be removably connected at attachment protrusions. The tube body 1 and end caps 2, 3 are preferrably corrugated or fluted with depressions and elevations 7 for additional strength. The interior portion of the tube may be lined with a cloth, felt or other suitable material to reduce abrasion. The length of the tube body can range from 12 inches (0.305 m) to 36 inches (0.914 m) or longer (preferred 18 inches (0.457 m)). The O-ring seal 12 or other esilient seal prevents water infiltration at the interface of the cap and tube body.

The end caps 2, 3 are preferably constructed of the same materials as the tube body 1 and include a plurality of attachment protrusions. The end caps are approximately 5 inches (0.127 m) to 14 inches (0.356 m) in diameter or more (preferred approximately 9 inches (0.229 m)) and 10 inches (0.254 m) to 30 inches (0.762 m) or more in length (preferred approximately 19 inches (0.483 m)). The end caps include a flat closed end and tapered or radially fluted portion configured to converge to overlap a rim of the tube body 1. The end caps 2, 3 are optionally be lined with cloth, felt or other suitable material in the same manner as the tube body to reduce abrasion.

Additionally, end cap 2 may be configured in a different orientation than end cap 3. More particularly, end cap 2 can include a smaller length or diameter than end cap 3. Each end cap is preferably configured to meet specific balancing requirements.

Figure 15:
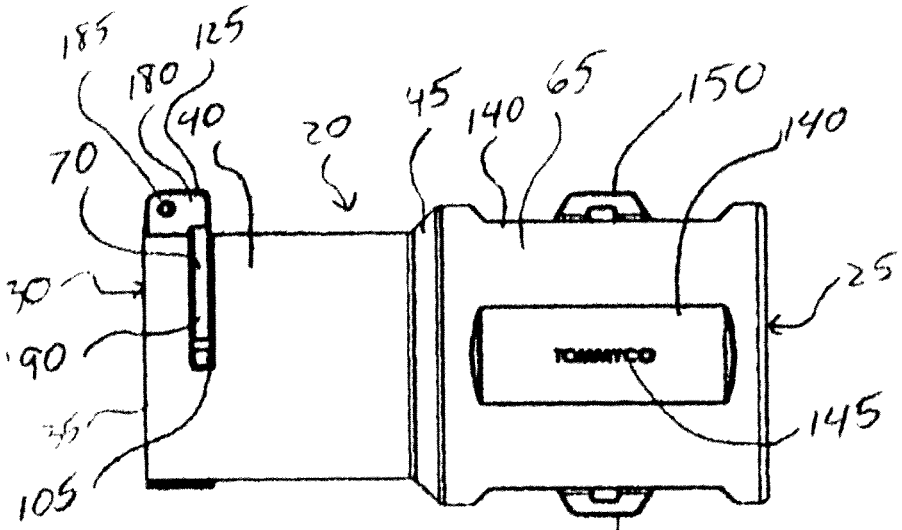
FIG. 15 is a side view of the cap of the container device.
Figure 16:
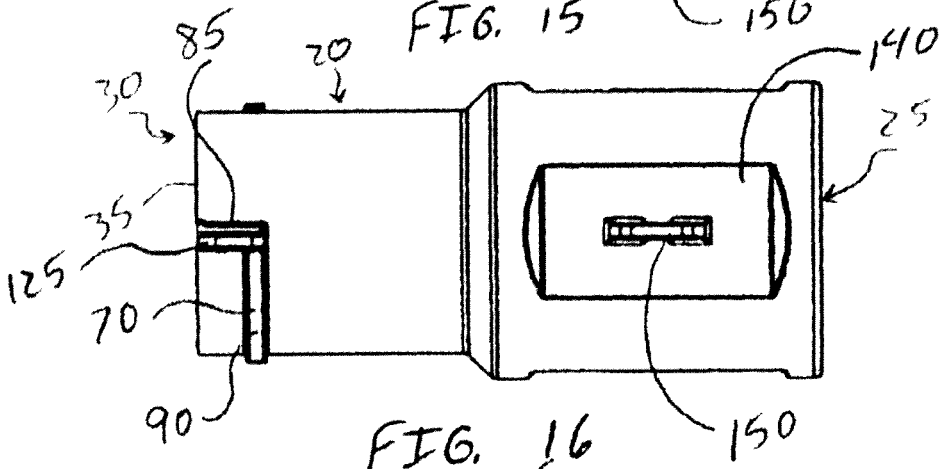
FIG. 16 is a top view of the container device.
Figure 17:
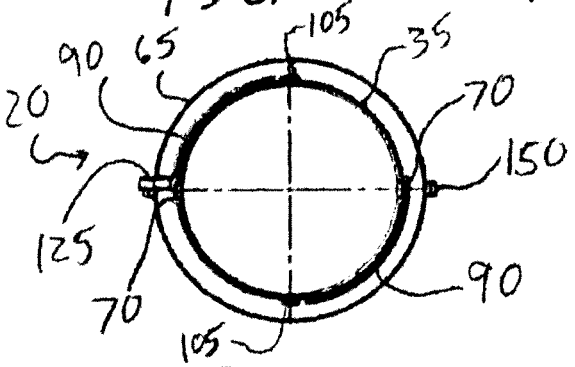
FIG. 17 is an end view of the cap of the container device.
Figure 18:
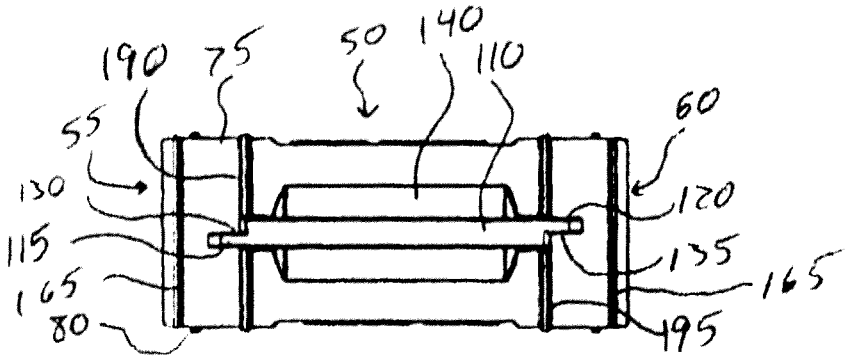
FIG. 18 is a top view of the tube body of the container device.
Figure 19:
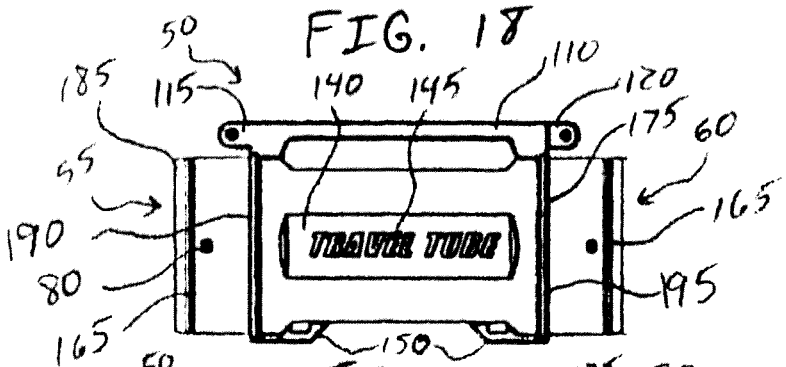
FIG. 19 is a side view of the tube body of the container device.
Figure 20:
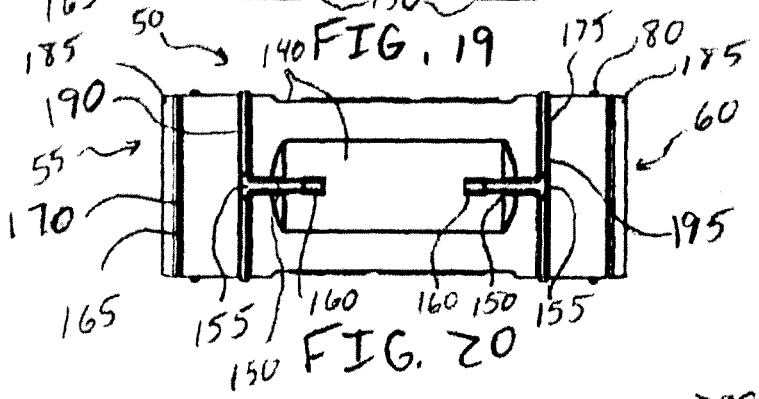
FIG. 20 is a bottom view of the tube body of the container device.

In another embodiment, the container device includes first and second end caps 20 that are operably attached to a first open end 55 and an oppositely disposed second open end 60 of a tube body 50. FIGS. 15-17 illustrate one embodiment of the first and second end caps 20 and include a generally similar configuration such that each end cap 20 can be operably attached to the first open end 55 or the second open end 60 of the tube body 50. Notably, the end cap 20 is made of a unitary thin wall material such as a rigid polymer or plastic (ie. linear low density polyethylene—LLDPE) and defines a cavity. However, other materials can be used. The end cap 20 includes a closed base end 25 and an oppositely disposed attachment end 30 that is configured to operably attach to either the first open end 55 or second open end 60 of the body tube 50 (FIGS. 18-20). In this embodiment, the attachment end 30 includes a rim 35 that has a generally circular cross sectional area that is greater than the cross sectional area of the open ends of the tube body 50 and is configured to selectively attach thereto in a male to female type connection.

Figure 23:
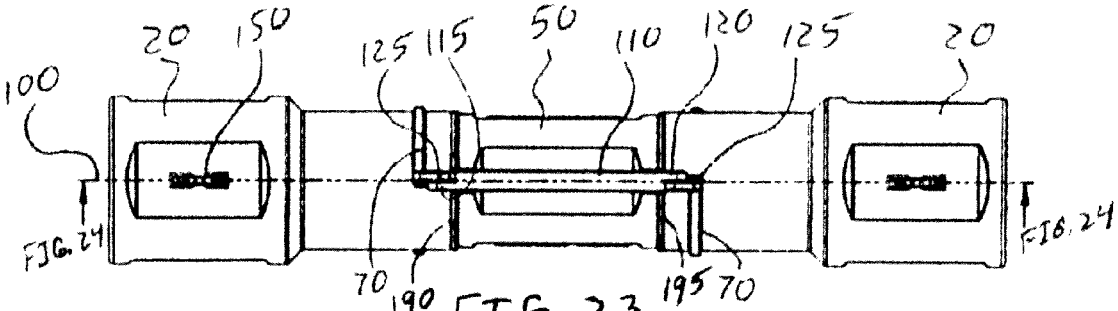
FIG. 23 is a top view of the container device.
Figure 24:
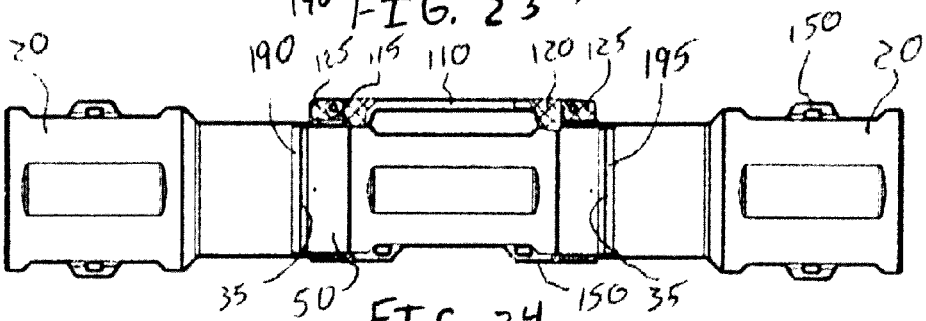
FIG. 24 is a cross sectional view of the top view of the container device as illustrated in FIG. 23.
Figure 25:
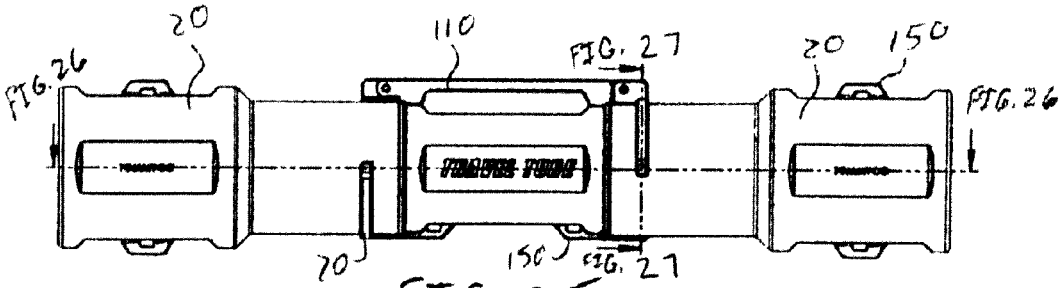
FIG. 25 is a side view of the container device.
Figure 26:
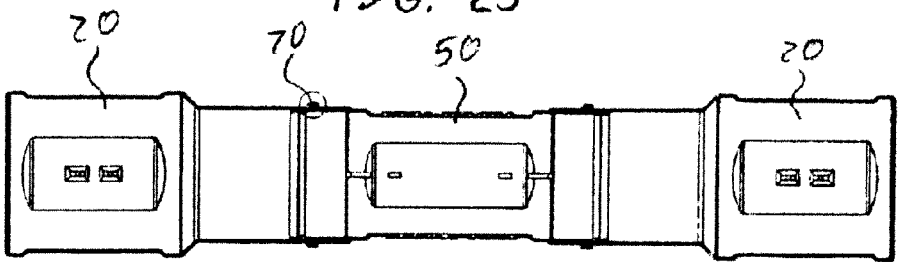
FIG. 26 is a cross sectional view of the side view of the container device as illustrated in FIG. 25.
Figure 27:
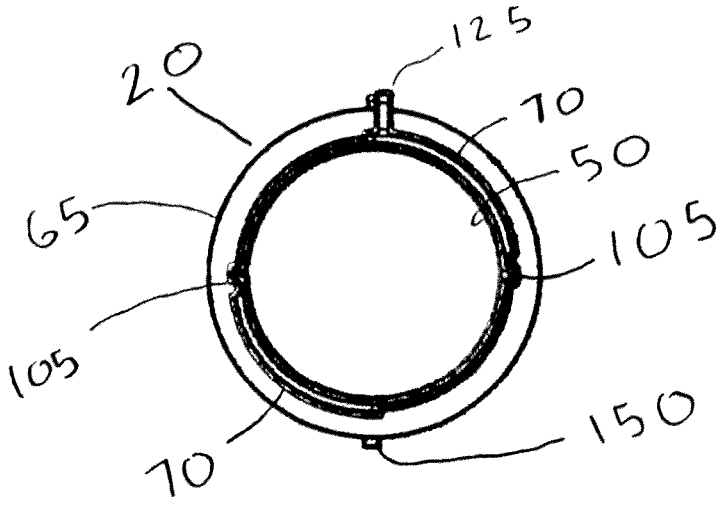
FIG. 27 is a cross sectional view of the side view of the container illustrated in FIG. 25.
Figure 28:
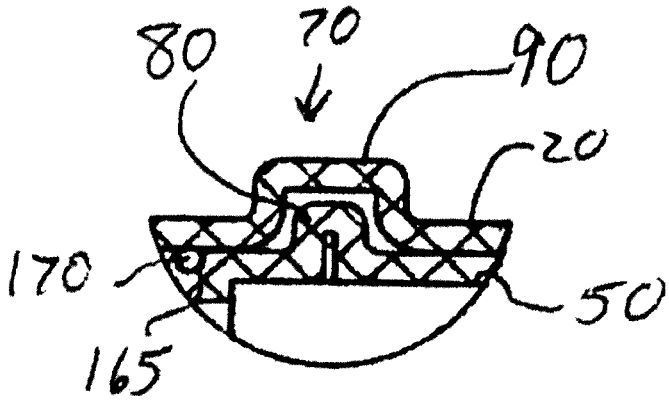
FIG. 28 is an exploded view of a threaded connection of the cross sectional view of the side view of the container illustrated in FIG. 26.

As shown by FIGS. 18-20, the tube body 50 is made of a unitary thin wall material and can be generally cylindrically shaped with a hollow structure. A handle 110 can be positioned along an outer surface 75 of the tube body 50 and can be integrally formed to the surface 75 by a pair of handle legs or separately connected thereon. The handle 110 includes a first stop 115 and a second stop 120 formed on opposing ends of handle 110. With particular attention to FIG. 18, the first and second stops 115, 120 are adapted to abut cap stops 125 that are located on each cap end 20. In one embodiment, the first and second stops 115, 120 axially extend in a generally parallel orientation relative to a longitudinal axis 100 of the tube body 50. The first stop 115 extends past a first radial shoulder 190 towards the first open end 55 and the second stop extends past a second radial shoulder 195 towards the second open end 60. The first stop 115 has a first recess 130 and the second stop has a second recess 135 located on an opposite side of the handle as the first recess 130. As illustrated by FIG. 23-25, the cap stop 125 is adapted to substantially fit within the recess as the cap 20 is attached to the tube body 50 such that the cap stop 125 and first stop 115 or second stop 120 are properly aligned along the longitudinal axis 100. Thus, this configuration allows the caps to maintain a generally similar orientation and attach to either open end of the tube body.

In one embodiment, the tube body 50 and/or the caps include at least one depression 140 thereon. The depressions 140 improve the rigidity and strength of the caps 20 and tube body 50. In FIGS. 15-16 and 18-20, four depressions 140 are provided with one depression located on each side of both the cap 20 and the tube body 50. Additionally, shaped elevations 145 can optionally be formed along the surface 75 and preferably be formed along the depressions 140. In one embodiment, elevation 145 can be in the shape of text "TRAVEL TUBE" extending along at least one of the depressions 140.

Radial shoulders 190, 195 are positioned annularly about the surface 75 of the tube body 50. The radial shoulders 190, 195 are adapted to abut the rim 35 of each end cap 20. In one embodiment, the first radial shoulder 190 is located axially inward from the first open end 55 and the second radial shoulder 195 is located axially inward from the second open end 60 and extends annularly about the surface 75. The radial shoulders can be aligned with the edge of handle leg extending from the handle 110 such that the first and second stops 115, 120 extend towards the first open end and second open end 55, 60, respectively. This configuration assists to position each cap 20 into secure attachment on the tube body 50.

Additionally, at least one attachment protrusion 150 can project radially from the end caps 20 or tube body 50. The radial shoulders 190, 195 can optionally be aligned with the attachment protrusions 150 located along the surface 75 of the tube body 50 opposite from the handle 100. In this embodiment, as illustrated by FIG. 20, a proximal end 155 of the attachment protrusion 150 is aligned with and extends from one of the radial shoulders and an opposite distal end 160 of the attachment protrusion 150 is attached to the tube body 50 within a depression 140. The proximal end 155 has a wider base than the distal end 160 and it aligns with a first lateral ridge 85 of the thread member 70 of the cap 20 when the cap is attached to the tube body 50.

Additionally, a seal channel 165 is recessed annularly about the first open end 55 and second open end 60 such that an o-ring 170 can be positioned thereon to assist preventing water intrusion. A second o-ring 175 can be positioned annularly about the tube body 50 at a location adjacent the radial shoulder 95. The second o-ring 175 is positioned between the rim 35 of the end caps and the surface 75 of the tube body 50 to help prevent excess rattling and assist to assure a snug fit between the end caps and tube. In one embodiment, the first open end and the second open end 55, 60 includes an radially inwardly disposed taper 185 to assist fitting the cap 20 to the tube body 50.

The first and second end caps 20 include an annular profile that includes a neck portion 40 that extends from the rim 35 to a radially fluted portion 45. The radially fluted portion 45 extends from the neck portion 40 to an end portion 65 that is attached to the closed base end 25. The radial fluted portion 45 expands the annular profile of the end cap radially such that the cross sectional area of neck portion 40 is less than the cross sectional area of the end portion 65. In one embodiment, the radially fluted portion has a generally conical or frusto-conical configuration. However, this configuration is not limited as the fluted portion 45 can also be, for example, a generally perpendicular radial ledge or a rounded corner type profile.

Further, the neck portion 40 includes at least one thread member 70 that is configured to align along the surface 75 of the tube body 50 such that the thread member coincides with at least one protrusion such as a key block 80 located thereon. The thread member 70 may comprise any configuration that is adapted to attach to tube body 50. In one embodiment, the thread member 70 includes a first lateral ridge 85 extending from the rim 35 that is generally perpendicular to a longitudinal axis 100 of the tube body 50 and a second radial ridge 90 that abuts the first lateral ridge and extends about a portion of the perimeter of the neck 40. In one embodiment, the second radial ridge 90 extends a quarter turn about the perimeter of the neck portion 40.

The first lateral ridge 85 is configured to receive the key lock 80 at an opening along the rim 35 and be guided axially along a portion of the neck 40. The key lock 80 is configured to abut the second radial ridge 90 as the rim 35 abuts the radial shoulder 95 located annularly along the surface 75 of the tube body 50. The radial shoulder 95 and key block 80 are axially spaced a predetermined distance along the surface 75 to coincide with the second radial ridge 90 and rim 35 of the end cap 20 to provide a snug and secure attachment between the end cap and tube body. A detent or recess 105 is included at an end of the second radial thread 90 to receive and hold the key lock 80 in place such that the tube body is prevented from unintentionally rotating loose.

Cap stops 125 extends from the first lateral ridge 85 and includes a hole therein that is configured to align with a hole located on the first stop 115 and the second stop 120 extending from the handle 110. In one embodiment, the cap stops 125 include an enlarged surface 180 adjacent the hole. Thus, a user engages the enlarged surface 180 to rotate the cap 20 and to overcome a fastening force that maintains the key block 80 within the recess or detent 105 of the thread member 70.

Figure 21:
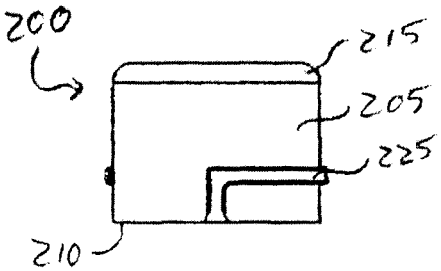
FIG. 21 is a front view of another embodiment of the cap of the container device.
Figure 22:
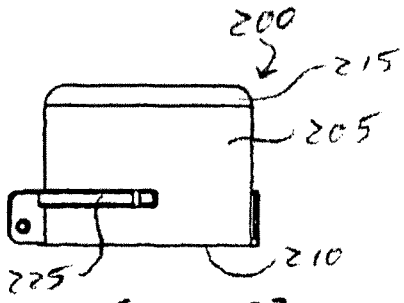
FIG. 22 is a side view of another embodiment of the cap of the container device.

In another embodiment, as illustrated by FIGS. 21 and 22, a small end cap 200 can be used in place of either the first or second end caps 20. The small end cap includes and annular profile having a generally cylindrical neck portion 205 extending axially from a rim 210 to a rounded annular edge 215. The rim 210 defines an opening configured to attach to the tube body 50 and the rounded edge 215 abuts a closed base end 220. Additionally, the small cap 200 includes a threaded attachment portion 225 generally similar to the thread member 70 of the end caps 20.

This attachment configuration provides a robust system that allows a user to store and transport elongated articles in a secure and balanced manner. Also, this configuration assists to ensure that each end cap is adapted to be axially aligned to the longitudinal axis of the tube body such that the cavity formed by the first end cap is in communication with the cavity formed by the second end cap through the tube body.

The container generally includes two end caps 20, one on each open end of the body tube 50, that have a generally similar configuration. However, this disclosure is not limited as the use of different end cap configurations is also contemplated. For example, in another embodiment, the rim 35 can have a cross sectional area that is generally less than the cross sectional area of the open end 55 of the tube body 50 for attachment thereto. (not shown) This embodiment is a reverse of the male/female type connection of the previous embodiments. The first end cap can be configured with a female type attachment to the male type configuration at the first open end of the tube body. Additionally, the second end cap can be configured with a male type attachment end for connection to the female type second open end of the tube body as disclosed above. The tube body includes both a female end and a male end, such that the female end is configured to receive the male end of either an additional tube body or the male end of the end cap. This orientation allows the container to be extended or reduced in size due to its generally modular configuration.

This modular configuration allows a user to transport elongated articles of different lengths such as ski equipment or fishing poles but is not limited thereto. Additionally, the cap end having a male attachment end can be configured to attach directly to another cap end having a female attachment.

Accessory bags are optionally attached to the container and are made of nylon netting, polyester or any suitable material type typical in the art to make varying size bags for storage of small items such as golf balls, tees, gloves, ammunition, or fishing tackle. The accessory bags include at least one clip made of a rigid material such as metal, plastic or any other material and are configured to allow for quick attachment to attachment protrusions 4, 150 located on the tube bodies 1, 50 and end caps 2, 3 or 20. The accessory bags optionally include zippers, snaps or buttons to access the interior portion of the bags.

A shoulder strap can optionally attach to the container device by similar type clips as the accessory bags to allow for quick attachment to the tube bodies 1, 50 and end caps 2, 3 and 20. The shoulder strap is configured to allow an associated user carry the container in a balanced manner. The strap includes an adjustable length stability and comfort and is generally made of nylon or any other suitable material known in the art. An optional padding is adapted to the strap for added comfort to the associated user. The strap is intended to carry the container device during play or transport by attachment to attachment protrusions located on the tube bodies 1, 50 and end caps 2, 3 and 20.

A club divider can be optionally provided within the container device. The divider is generally made of cloth covered rubberized material configured to stretch over the first or second open ends of the rim of the tube bodies 1, 50 during play. The divider is configured in a grid pattern and adapted to divide equipment such as golf clubs within the container device.

A wheel attachment can be adapted to attach to the container device. In one embodiment the wheel attachment is connected to a bottom end cap of the device to allow for rolling of the device on a plurality of wheels. Additionally, a bi-pod stand can be adapted to the container device that is operative to support the container in an upright manner. The bi-pod stand and can be attached to the tube body by any known manner in the art.

The container device is adapted to store the accessory bags, shoulder strap and club divider and other associated items or equipment to be transported in tube bodies 1, 50 or end caps 2, 3 and 20. The end caps 2, 3 and 20 attach to the tube bodies 1, 50 by the threads 8 or thread member 70, respectively or can optionally be configured to attach by other attachment configurations known the art such as clamps, fasteners, snaps, buttons, keys or tongue and groove arrangements. The quarter turn thread is the preferred attachment embodiment. When the device is in use for travel purposes, such as carrying golf clubs or other differentially weighted items, the items can be inserted from either end of the device and distributed such that the weight is balanced in an equilibrium state. More particularly, storing the club heads, cantilevered items or dissimilar articles on both ends facilitate use of optimum storage space in a compact arrangement. This equilibrium state allows for equal weight distribution.

Additionally the varying internal dimensions of tube bodies 1, 50 and end caps 2, 3 and 20 allow for versatility in carrying items other than golf clubs. The diameter of the body 1 may accommodate club shafts, shoes, and other golf apparel. Accessory bags, a shoulder strap and club divider can be quickly attached to tube bodies 1, 50 and end caps 2, 3 and 20 via the attachment protrusions for use in transport and play. The caps and tube body attach with a locking stop device which insures the rotational movement of the cap stops in the same alignment to the body and prevents unintended opening of the device due to end cap rotation. A locking device can be inserted the locking stop points to secure the caps to the tube body.

Golf clubs or any other items requiring safe water resistant travel are placed in the tube body. The weight and size of each club should be distributed evenly on each end of the device to allow for equal weighting and maximum storage. The tube body and the end caps then can be used for storage of straps, handles, accessory bag, apparel, and miscellaneous items. The end caps are then attached to the tube body by the quarter turn locking thread and sealed with o-ring seals or any other seal know to the art. Once the device is sealed it can be attached via the attachment protrusions or locking stops to an associated vehicle such as an SUV, ATV, Motorcycle or bicycle using conventional tie down straps or rope. The device may also be used as conventional luggage and can be locked and stowed for travel in bed of a pickup truck, air plane, boat, or any other vehicle. Upon arrival at a destination the caps can be removed and the items retrieved. For use as a golf bag the clubs can be positioned with all the club heads facing up and one end cap removed while the other end cap remains attached creating a stable base for the device in an upright position. The accessory bags, club divider, and shoulder strap can be attached to the exterior of the device to allow for the bag to be used in play.

The container solves the problem of carrying your golf clubs or other items while being protected from an exposed environment where collisions with other hard surfaced items or the elements could cause damage. The device easily and safely mounts golf clubs or other items to a motorcycle, bicycle, ATV, or other vehicle without the use of brackets or other mounting devices while maintaining a balanced equilibrium. The sports container device is compact, light-weight, durable, shipping container, which can still be used in the play of golf.

The container is constructed of thin walled plastic or any other suitable light-weight material which can be molded or machined and may be corrugated or fluted for added strength. The diameter of the body is narrow enough to only allow for club shafts and some accessory items such that a compact design is maintained. The end caps may have a larger diameter to allow for club heads, head covers, and accessories on both ends such that an even weight distribution is balanced across the length of the tube. Even weight distribution or equilibrium provides for appropriate balance when adhered to a motorcycle during travel and also assists in carrying the clubs via the handle or shoulder strap. The container device is configured to allow the bag to be set in the upright position with relative stability. The end caps can be threaded or attached by any mechanical means typical to the art. In one embodiment, a quarter turn locking channel and thread key block assembly is the preferred attachment assembly. Additionally, o-ring seals or other resilient seal is operative to maintain water resistance at an attachment point between the tube and the caps. Attachment protrusions can be provided integral to the tube and caps or independently mounted thereto. The attachment protrusions provide a stable point for the device to be tied down by a strap, rope or other resilient member to a motorcycle, bicycle or any other vehicle during transport. Attachment protrusions also serve as connecting points for a shoulder strap, an accessory bag or a locking device. The compact and balanced configuration is conducive for attachment to motorcycle, ATV, luggage rack, boat or virtually any vehicle. The container device is versatile and may include different sized tubes and end caps to allow for storage, protection, and transport of a wide range of items, such as fire-arms, fishing equipment or anything which lends itself to the size and shape of the device.

In one embodiment, depressions and elevations of the plastic materials utilized for functional size, structural stability and to display indicia. The depressions and elevations add considerable strength to the structure of the device. This allows for thinner wall thickness which results in less weight and less cost in manufacture. This device is designed to be manufactured with a wall thickness ranging from under 0.05 inches (0.127 cm) to over 0.15 inches (0.381 cm) without compromising the rigidity of the device. This range of wall thickness allows for a wide variety of structures manufacture by plastic molding equipment. The device can be easily manufactured by rotational molding, form molding, blow molding, or injection molding. Each element allows for variety of manufacture methods and versatility in costs.

The tube and the caps can be compact having a relatively short longitudinal length while having sufficient space therein. In one embodiment, the caps are approximately 19 inches (0.4826 m) in length and the tube body is approximately 18 inches (0.4572 m) in length. This size configures the container device in a compact manner with a sealed overlapped connection while providing the preferred assembled length of 50 inches (1.27 m). This design characteristic reduces the cost of manufacture by keeping tooling and machine size within the capabilities of smaller molding manufacturing equipment. Additionally, utilizing reduced size pieces reduce packaging, shipping and distribution costs.

In one embodiment, the caps are operatively attached to the tube by a quarter turn thread system. The quarter turn tread includes a ridge in the interior of the thread on the cap piece. The ridge allows for a detent and recess snap type closure when the thread passes over the detent or key block and prevents the cap from rotating loose.

The O-ring provides a water tight seal and also increases friction helping to prevent the caps from rotating loose. A slight bevel or bend at a rim of the tube body allows for the cap to be easily placed onto the body of the device. Locking tabs protrude from the caps and tube body to stop rotation of the cap in a position of alignment with the tube body. Locking stops can receive an associated security lock or act as another attachment protrusion. A molded handle is positioned over a structural depression on the tube body to increase rigidity and provide a balanced grip for carrying the container device.

The container device can be made by any type of plastic molding and forming known in the art. The container device components could optionally be machined out of plastic, aluminum or other suitable light weight construction material. Suitable materials are configured to be light-weight, water resistant, durable, and moldable. Fiberglass or carbon fiber can be optionally used.

An user would use this invention to carry golf clubs, firearms, fishing rods, blue prints, or any other Item, which lends itself to the shapes and sizes available. A person could equally weight the items to allow for stable transport on a motorcycle or ATV and the device is durable enough to allow for items to be exposed to the elements indefinitely. The device will protect its contents from impact, water, and abrasion. A person could ship this package via standard mail or check the item as luggage in public transportation. A person can use the device as a standard carry or cart golf bag during play.

The device can be configured in multiple orientations and used for multiple purposes as disclosed. It could also be used as a floatation device or to carry and store liquids. The device could be used as a container for bulk or loose materials or weighting of vehicle for added traction during slippery conditions.

The disclosure has been described with reference to the preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

The invention claimed is:

1. A container device comprising:

a tube body made of a unitary thin wall material with a first open end and an oppositely disposed second open end;

a first end cap made of a unitary thin wall material defining a cavity with a first closed base end and an oppositely disposed first attachment end, the first attachment end having a first rim with a greater cross sectional area than the first open end of the tube body and being configured to operably attach to the first open end of the tube body; and a second end cap made of a unitary thin wall material defining a cavity with a second base end and an oppositely disposed second attachment end, the second attachment end having a second rim with a greater cross sectional area than the second open end of the tube body and is configured to operably attach to the second end of the tube body such that the cavity formed by the first end cap is in communication with the cavity formed by the second end cap through the tube body;

wherein the first end cap and the second end cap include generally similar configurations such that each end cap can be operably attached to the first open end or the second open end of the tube body;

wherein the first and second caps include a profile such that each attachment end includes a neck portion extending from the rim to a radially fluted portion, the radially fluted portion extends from the neck portion to an end portion that is attached to the closed base end; and wherein the neck portions include at least one thread member that is configured to coincide with at least one key block located on a surface of the tube body.

2. The container device of claim 1 wherein the neck portion and end portion are generally cylindrical.

3. The container device of claim 1 wherein a cross sectional area of the neck portion is less than the cross sectional area of the end portion.

4. The container device of claim 1 wherein the at least one thread member includes a first lateral ridge extending from the rim that is generally perpendicular to a longitudinal axis of the tube body and a second radial ridge that abuts the first lateral ridge and extends a portion about the radial perimeter of the neck portion such that the thread member is configured to receive the key lock at the rim and be guided along the thread member.

5. The container device of claim 4 wherein the second radial ridge extends radially about a quarter of the perimeter of the neck portion of the first and second end caps.

6. The container device of claim 4 wherein the thread member includes a detent or recess that is configured to receive and hold the key block when the first or second end caps are attached to tube body such that the cap is held in place and prevented from rotating loose.

7. The container device of claim 1 wherein the unitary thin wall material of the tube body, first end cap or second end cap includes a corrugated or a fluted configuration with at least one depression or elevation.

8. A sports container apparatus comprising;

a tube having opposed open ends;

first and a second end caps are configured to be operably attached to each open end in a sealed manner, respectively;

the first and second end caps including a neck portion extending from a rim of the cap to a radially fluted portion, the radially fluted portion extending from the neck portion to a closed end portion such that the end portion includes a cross sectional area greater than a cross sectional area of the tube, the neck portions include at least one thread member that is configured to coincide with at least one key block located on a surface of the tube, the thread member includes a lateral ridge extending from a rim that is generally perpendicular to a longitudinal axis of the tube and a radial ridge that abuts the lateral ridge and extends a portion about a radial perimeter of the neck portion such that the thread member is configured to receive the key lock at the rim and be guided along the thread member.

9. The sports container apparatus of claim 8 wherein the sports container is convertible for use as a golf bag.

10. The sports container apparatus of claim 8 wherein a combined length of the first and second end caps is at least approximately 60%-80% of the size of the assembled container.

11. The sports container of claim 8 wherein at least one o-ring is used to provide a generally sealed connection between the first and second end caps and the tube.

12. A container apparatus comprising:

a tube section having a first open end with a male type configuration and an opposing second open end with a female type configuration;

a first end cap and a second end cap configured to be attached to said ends, respectively;

the first and second end caps have an annular profile that includes a neck portion extending from a rim of the end cap to a radially expanded portion, the radially expanded portion extends from the neck portion to a closed end portion;

the first end cap includes a female type attachment end that is adapted to attach to the male type configuration at the first open end of the tube body, the second end cap includes a male type attachment end that is adapted to attach to the female type configuration at the second open end of the tube body; and the first and second end caps abut a first radial shoulder and a second radial shoulder, respectively positioned along a surface of the tube body.

13. The container apparatus of claim 12 further comprising:

a first stop that radially protrudes from the tube body at a position between the first and second radial shoulders and extends past the first radial shoulder towards the first open end and configured to abut a first cap stop;

a second stop radially protrudes from the tube body at a position between the first and second radial shoulders and extends past the second radial shoulder towards the second open end and configured to abut a second cap stop.

14. The container apparatus of claim 13 wherein the first cap stop radially protrudes from the neck portion, of the first end cap and is configured to attach to the first stop on the tube body and the second cap stop radially protrudes from the neck portion of the second cap end and is configured to attach to the second stop on the tube body.

15. The container apparatus of claim 14 wherein the first and second cap stops include holes that are adapted to align with holes through the first and second stops, respectfully.

16. The container apparatus of claim 12 wherein a plurality of attachment points extend from at least one of the first end cap, the second end cap and the tube.

17. The container apparatus of claim 12 further comprising an additional tube body with a similar configuration to the tube section, the tube body configured to be attached between the tube section and at least one of the first end cap and the second end cap such that the container apparatus can be extended.

* * * * *